US011354987B2

(12) United States Patent
Ko

(10) Patent No.: US 11,354,987 B2
(45) Date of Patent: Jun. 7, 2022

(54) SWIMMING POOL ENTRANCE OPENING WARNING DEVICE

(71) Applicant: Joseph Y. Ko, Laguna Niguel, CA (US)

(72) Inventor: Joseph Y. Ko, Laguna Niguel, CA (US)

( * ) Notice: Subject to any disclaimer, the term of this patent is extended or adjusted under 35 U.S.C. 154(b) by 262 days.

(21) Appl. No.: 15/931,177

(22) Filed: May 13, 2020

(65) Prior Publication Data

US 2021/0358277 A1 Nov. 18, 2021

(51) Int. Cl.
*G08B 13/08* (2006.01)
*G08B 21/08* (2006.01)

(52) U.S. Cl.
CPC ..... *G08B 13/08* (2013.01); *G08B 21/086* (2013.01)

(58) Field of Classification Search
CPC ..... G08B 13/08; G08B 13/18; G08B 21/00; G08B 21/02; G08B 21/06; G08B 21/086; E05F 7/00
See application file for complete search history.

(56) References Cited

U.S. PATENT DOCUMENTS 5,473,310 A * 12/1995 Ko ..... G08B 13/08 340/529
5,786,761 A * 7/1998 Hui ..... G08B 13/08 340/636.15
6,727,819 B2 * 4/2004 Ko ..... G08B 21/086 340/573.6
8,059,002 B2 11/2011 Chen
2008/0122618 A1 * 5/2008 Courter ..... G08B 21/086 340/541

FOREIGN PATENT DOCUMENTS

CN 201387655 Y 1/2010
CN 211827512 * 12/2020

OTHER PUBLICATIONS

NPL Search (Mar. 23, 2022).*

* cited by examiner

*Primary Examiner* — Van T Trieu
(74) *Attorney, Agent, or Firm* — Muncy, Geissler, Olds & Lowe, P.C.

(57) ABSTRACT

A swimming pool entrance opening warning device comprises at least one door magnetic switch, at least one bypass switch and a host, wherein the door magnetic switch is arranged on a door leading to the swimming pool entrance, the bypass switch is arranged on a building structure adjacent to the swimming pool entrance, the bypass switch being provided with a first release button, and the host is arranged on the building structure adjacent to the swimming pool entrance or the door, the host and the bypass switch be located at different positions, the host comprising a host shell, a speaker module arranged on the host shell, a second release button arranged on the host shell, and a control circuit board connected with the first release button and the second release button, while according to the invention, when the door is opened and two release buttons do not generate a release signal after passing a buffering time, the speaker module is actuated through the control circuit board, thereby preventing unauthorized personnel from entering and exiting the swimming pool.

10 Claims, 10 Drawing Sheets

SWIMMING POOL ENTRANCE OPENING WARNING DEVICE

FIELD OF THE INVENTION

The invention relates to a warning device, in particular to a swimming pool entrance opening warning device.

BACKGROUND OF THE INVENTION

An existing swimming pool entrance opening warning device is disclosed in U.S. Pat. No. 8,059,002, US 2008/122618, and CN 201387655. However, it can be known from the disclosures of the foregoing patents that a conventional swimming pool entrance opening warning device is provided at a swimming pool entrance and monitors the swimming pool entrance to prevent children or unauthorized personnel from entering and exiting the pool, but the conventional structure only comprises a single warning release button arranged on a host. That is to say, when a person who is allowed to enter the swimming pool intends to enter the swimming pool, the person is limited by the installation location of the host and must first operate the warning release button at the swimming pool entrance, and the person must return to the swimming pool entrance to operate the warning release button once the person has entered the swimming pool and forgotten to operate the warning release button in a hurry state, thus causing inconvenience for the person to enter and exit.

Further, although the aforementioned problems can be solved by the applicant's previous U.S. Pat. No. 6,727,819B, the applicant has found that there is still room for improvement of the structure disclosed in the aforementioned patent after a certain period of use, and thus the present invention has been created with great efforts to improve the method.

SUMMARY OF THE INVENTION

The main object of the present invention is to solve the problems deriving from the drawbacks of conventional structures.

In order to achieve the object, the invention provides a swimming pool entrance opening warning device, comprising: at least one door magnetic switch arranged on a door leading to the swimming pool entrance, wherein the at least one door magnetic switch comprises a first electric wire, and a door opening signal is output when the door is opened by the at least one door magnetic switch; at least one bypass switch arranged on a building structure adjacent to the swimming pool entrance, the at least one bypass switch being provided with a switch shell, a first release button exposed on the switch shell and operated to generate a release signal, and a second electric wire connected with the first release button; and a host arranged on the building structure adjacent to the swimming pool entrance or the door, the host and the at least one bypass switch be located at different positions, the host comprising a host shell, a speaker module arranged on the host shell, a second release button exposed on the host shell and operated to generate the release signal, a door magnetic switch expansion interface exposed to the host shell, a battery arranged in the host shell, and a control circuit board connected with the speaker module, the second release button, the first electric wire, the second electric wire, the door magnetic switch expansion interface and the battery, wherein the host shell comprises a bottom shell, an upper cover and a waterproof gasket arranged between the bottom shell and the upper cover, and the control circuit board including a first mode of actuating the speaker module when the door opening signal is received and the release signal has not been received after passing a buffering time, and a second mode in which the door opening signal is received and the release signal is received during the buffering time.

In one embodiment, the host includes a bypass switch interface arranged on the host shell and connected with the control circuit board, and the at least one bypass switch includes a plug arranged at an end of the second electric wire and connectable to the bypass switch interface.

In one embodiment, the control circuit board is composed of a motherboard and a daughterboard electrically connected with the motherboard, and the second release button is arranged on the daughterboard.

In one embodiment, the host includes a host status indicator light exposed on the host shell, and the host status indicator light is arranged on the daughterboard.

In one embodiment, the upper cover is formed with a retaining wall on a side where the bottom shell is assembled, and the retaining wall is formed with a stepped structure.

In one embodiment, the bottom shell is formed with at least one groove for providing a shroud thereon on a side which does not face the upper cover and at least two mounting posts which are formed in the groove and are used for assembly of the shroud, an area of the groove which is not shielded by the shroud being able to define two rope penetrating openings, the two rope penetrating openings being located on a same extension line, and a fastening hole being formed in the shroud.

In one embodiment, the at least two mounting posts are respectively formed with an assembly opening at a side facing the shroud, and the shroud comprises a positioning post provided at one of the assembly openings and a through hole corresponding to the other assembly opening for a screw to penetrate through.

In one embodiment, the upper cover is formed with a battery replacement opening used for replacement of the battery and is able to be assembled with an enclosure.

Through the previous disclosure, the invention includes the following characteristics in comparison with the prior art: the invention disposed the first release button on the bypass switch and the bypass switch and the host be located at different positions, so that a person authorized to enter the swimming pool entrance does not limit to operate the second release button at the swimming pool entrance due to the installation location of the host.

Compared with the prior art, the swimming pool entrance opening warning device of the present invention includes a plurality of release buttons which are located differently so as to be convenient to operate, and meanwhile the swimming pool entrance opening warning device which is different from the prior art in structure is provided.

DETAILED DESCRIPTION OF THE PREFERRED EMBODIMENTS

Figure 1:
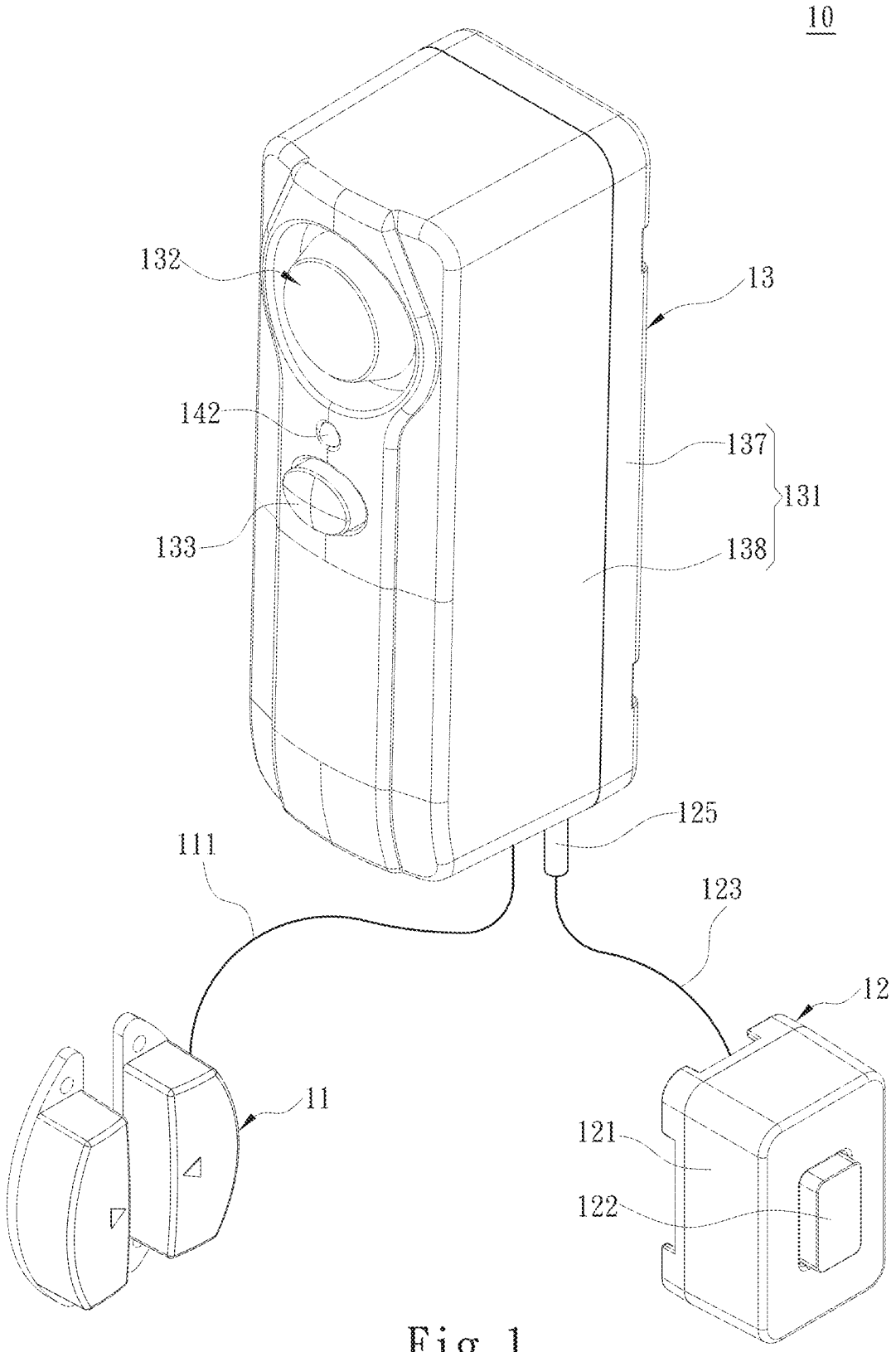
FIG. 1 is a schematic view showing a dimensional structure of an embodiment of the present invention.
Figure 2:
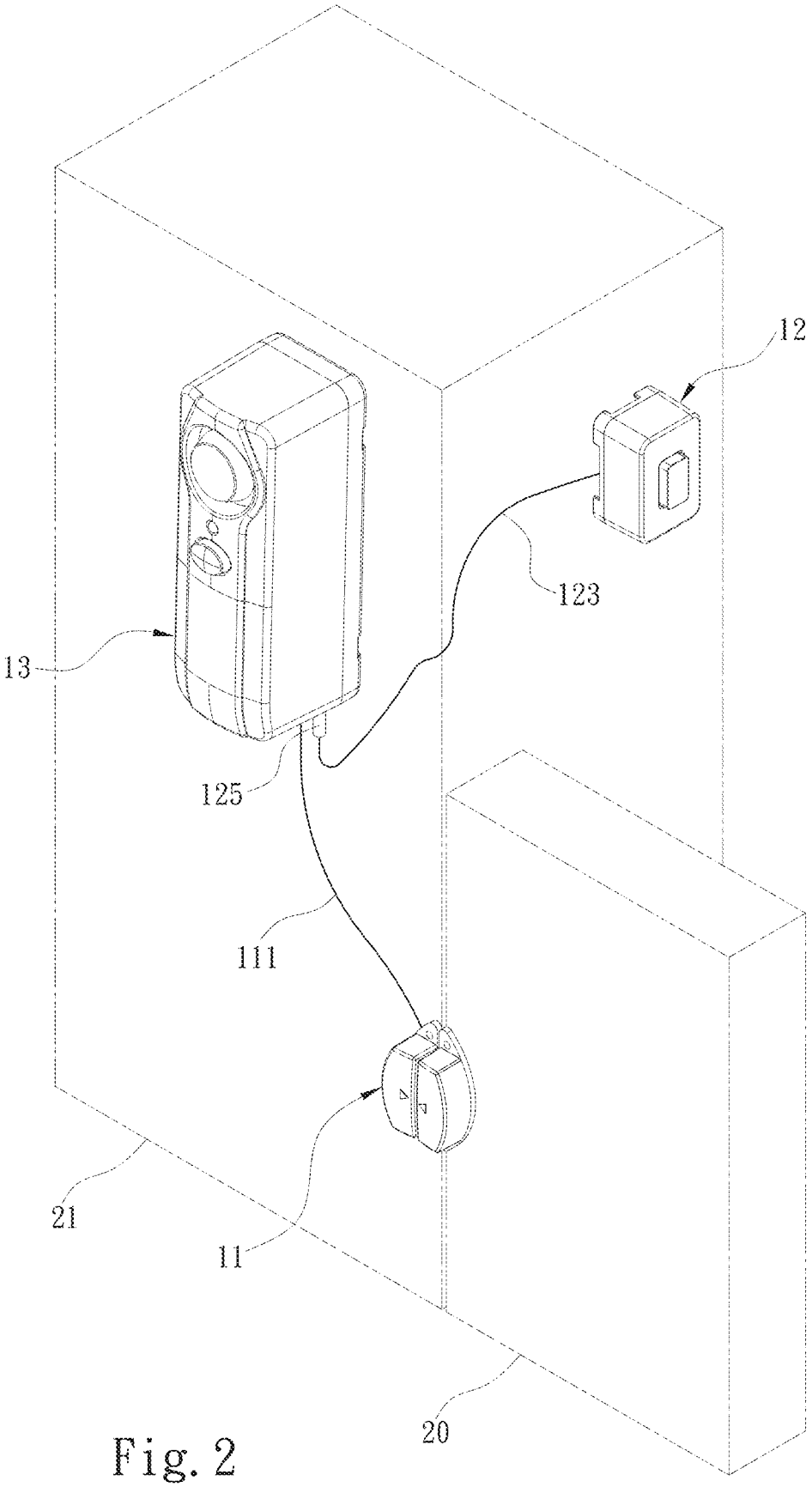
FIG. 2 is a schematic view showing set positions of an embodiment of the present invention.
Figure 3:
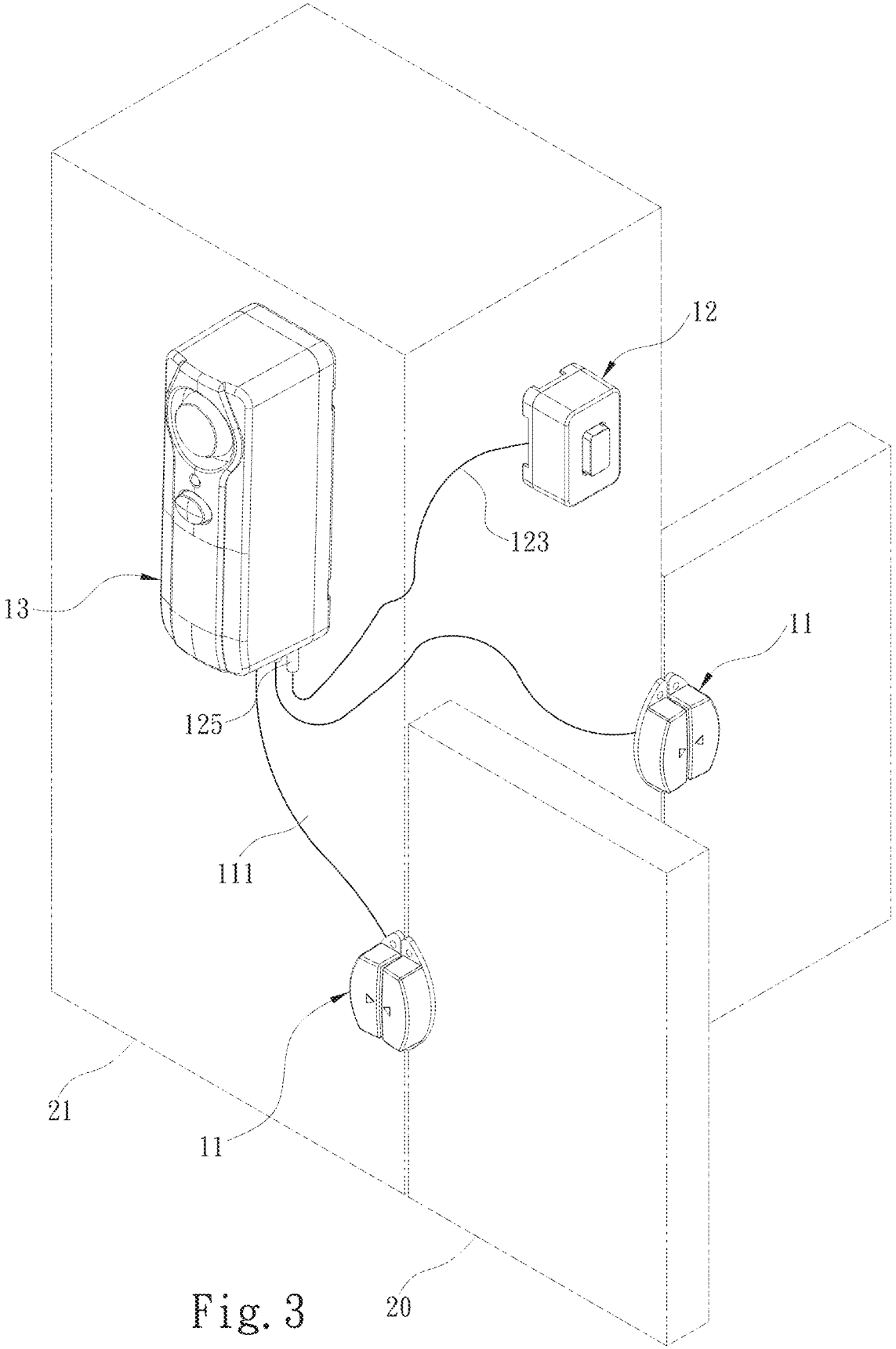
FIG. 3 is a schematic view showing set positions of another embodiment of the present invention.
Figure 4:
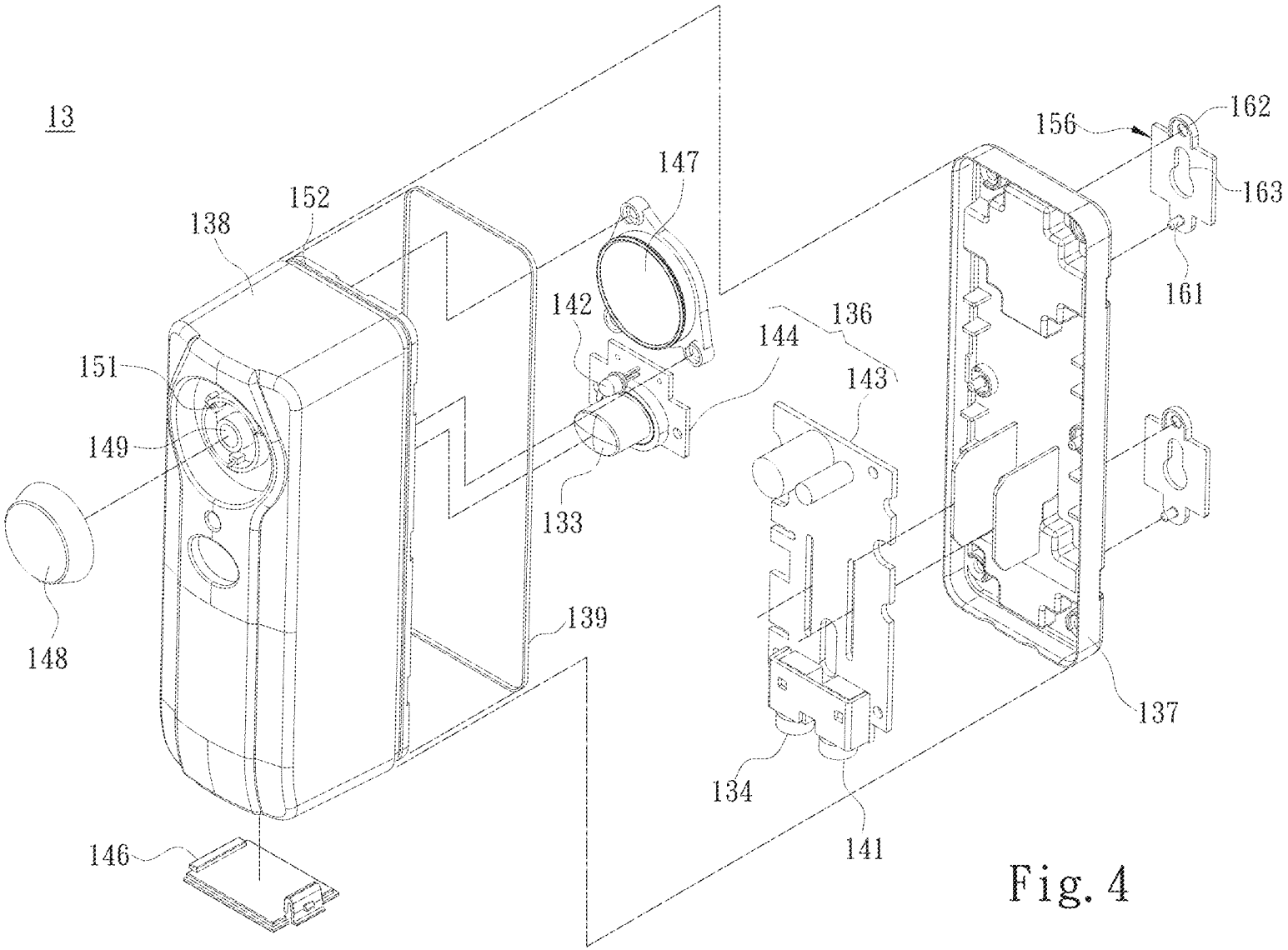
FIG. 4 is a first structural exploded schematic view of an embodiment of the present invention.
Figure 5:
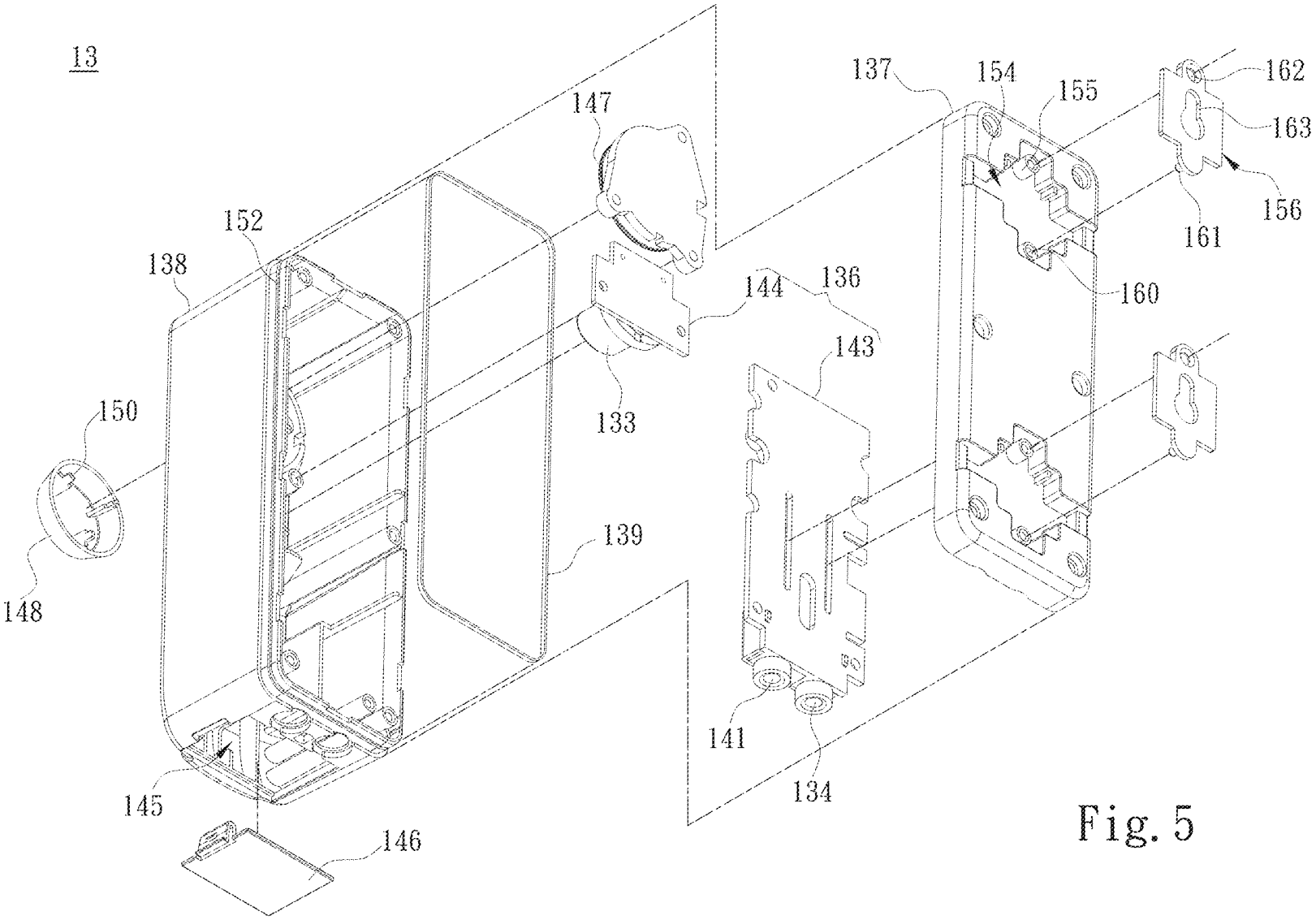
FIG. 5 is a second structural exploded schematic view of an embodiment of the present invention.
Figure 6:
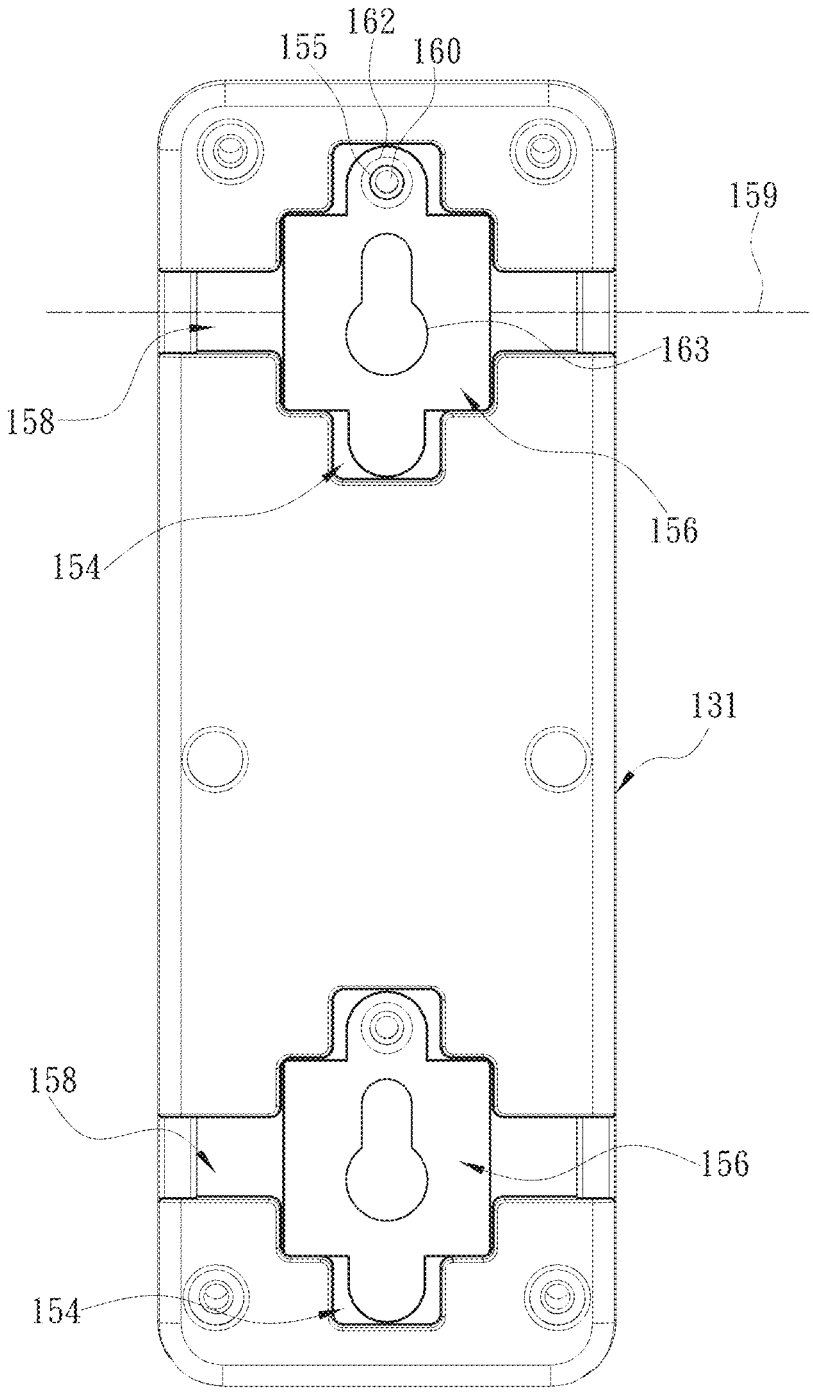
FIG. 6 is a structural rear plan schematic view of an embodiment of the present invention.
Figure 7:
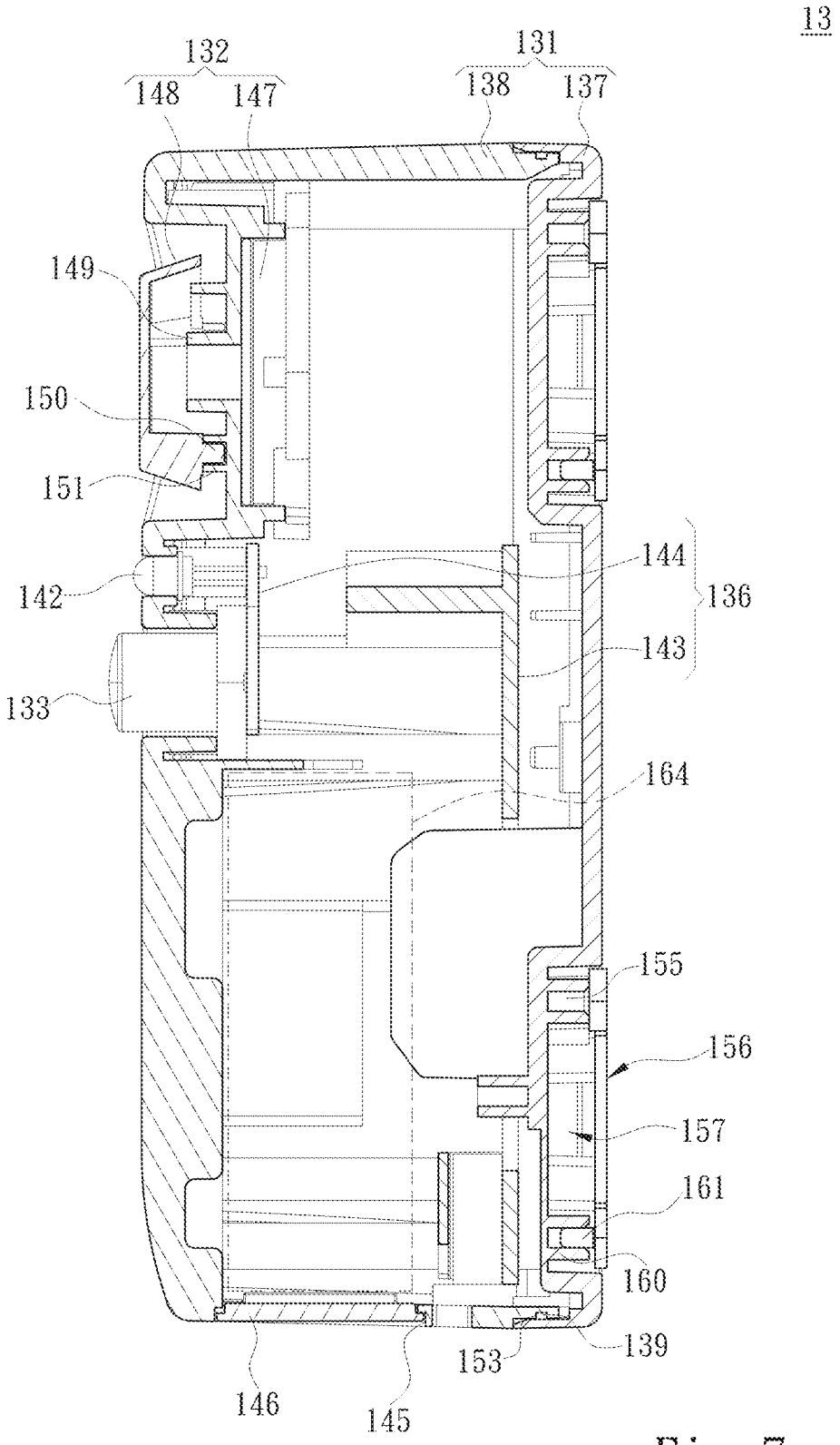
FIG. 7 is a structural cross-sectional schematic view of an embodiment of the present invention.
Figure 8:
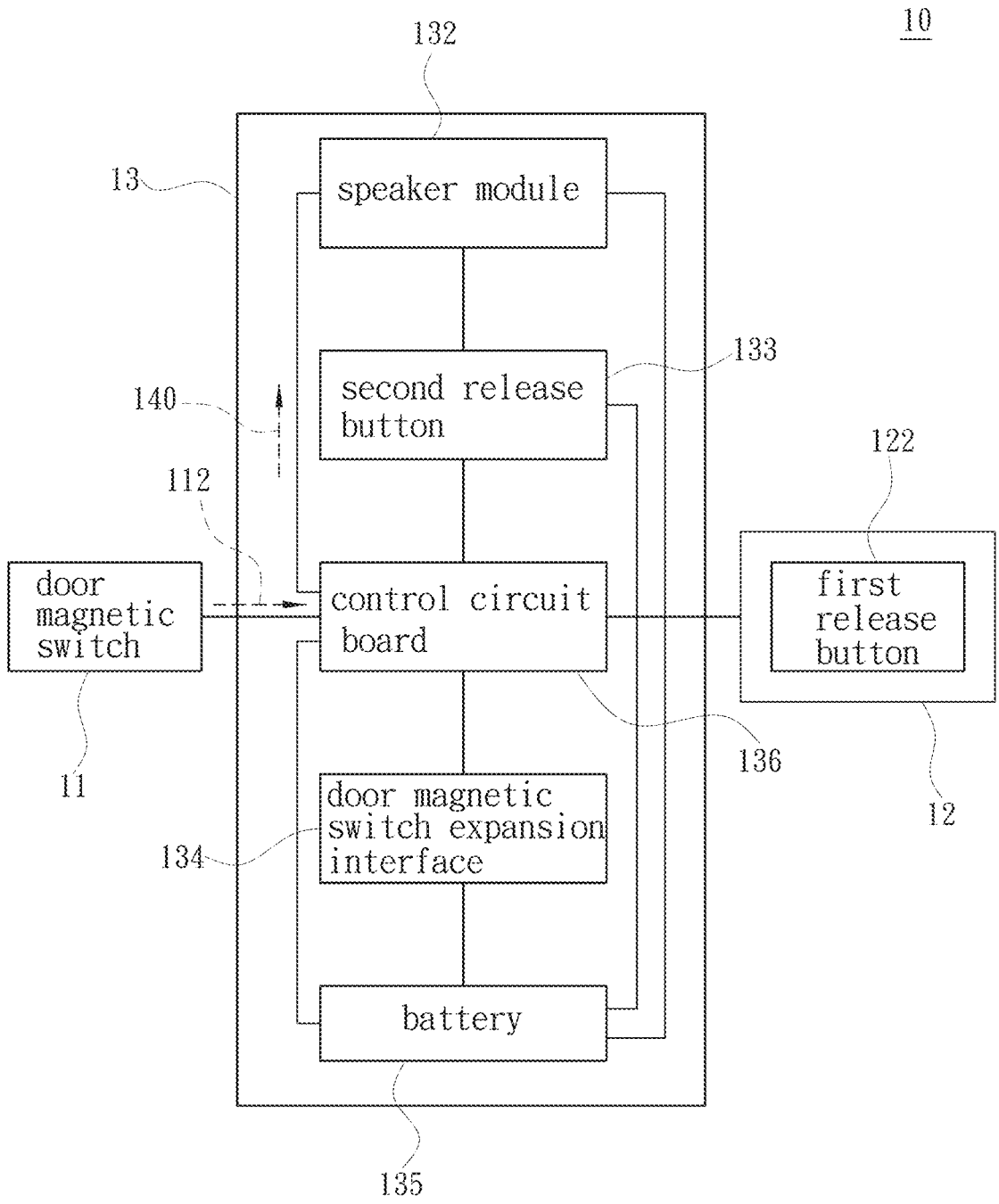
FIG. 8 is a schematic view of the first mode of an embodiment of the present invention.
Figure 9:
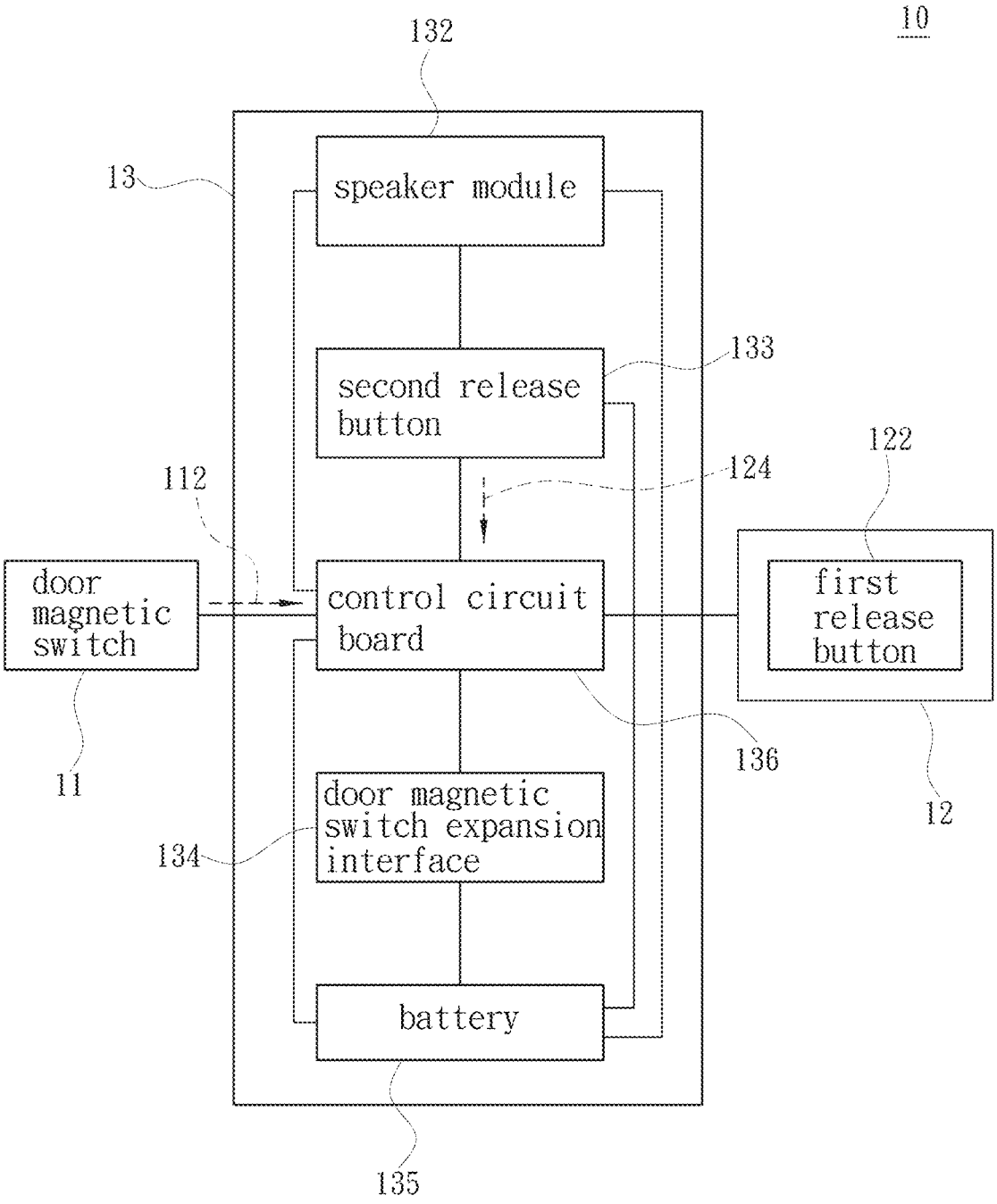
FIG. 9 is a first schematic view of the second mode of an embodiment of the present invention.
Figure 10:
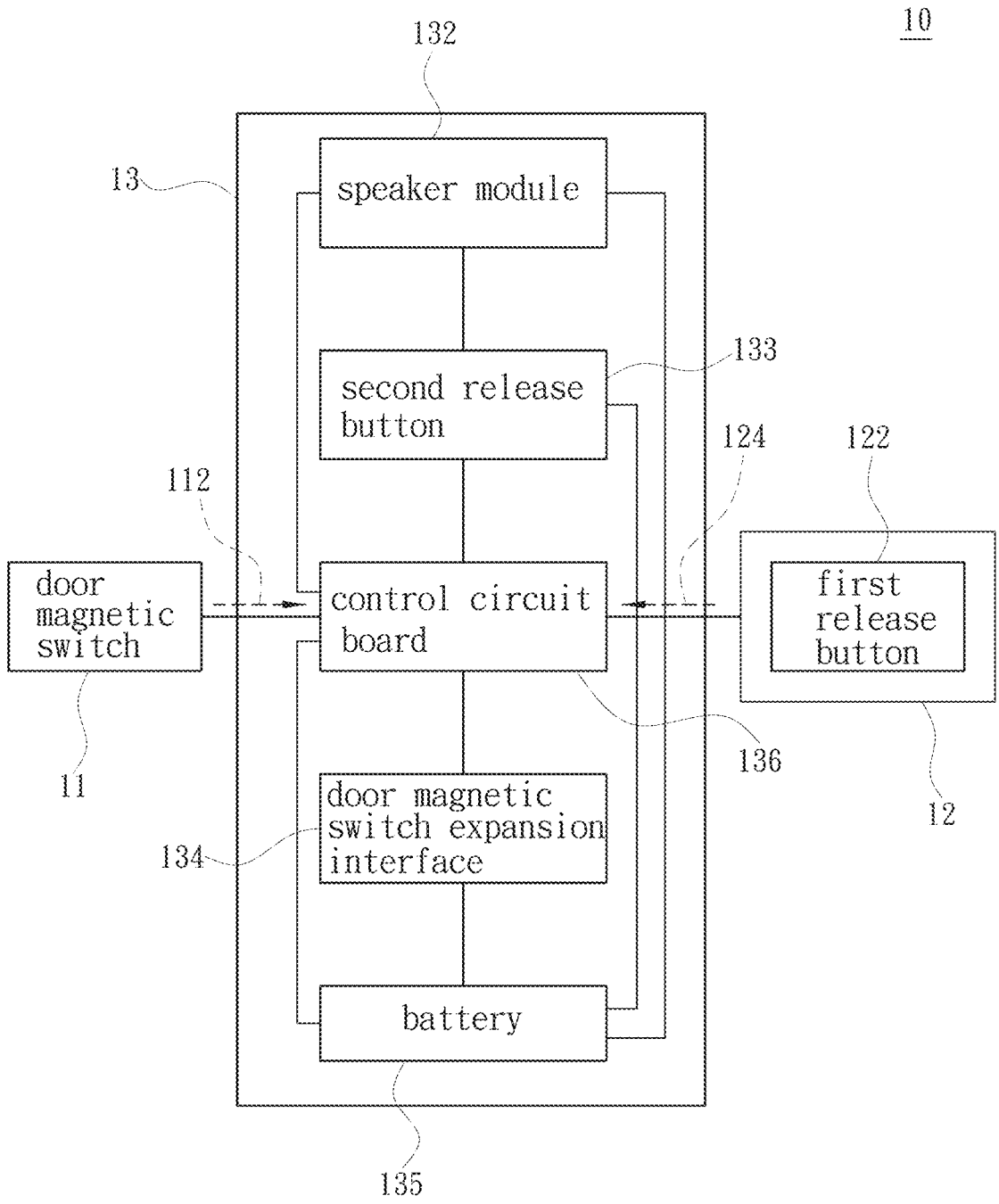
FIG. 10 is a second schematic view of the second mode of an embodiment of the present invention.

The detailed description and technical contents of the present invention will now be described with reference to the drawings as follows:

Referring to FIGS. 1, 2, 3, 4, 5 and 6, the present invention provides a swimming pool entrance opening warning device 10 which is comprising at least one door magnetic switch 11, at least one bypass switch 12, and a host 13, wherein the door magnetic switch 11 is arranged on a door 20 leading to a swimming pool entrance, and the door magnetic switch 11 comprises a first electric wire 111. In implementation of the door magnetic switch 11, a change of magnetic force thereof is detected to determine whether a current state of the door 20 is opened or not. When the door 20 is opened, the door magnetic switch 11 detects a decrease of the magnetic force thereof and then outputs a door opening signal 112, as shown in FIGS. 8, 9 and 10. When the door magnetic switch 11 is provided in singular, the first electric wire 111 of the door magnetic switch 11 is directly assembled to the host 13. In addition, the door magnetic switch 11 can be expanded in plural according to requirements, and a plurality of door magnetic switches 11 can be respectively arranged on the doors 20 leading to the swimming pool entrance at different positions, thereby respectively determining each of the doors 20 is opened or not. Further, the bypass switch 12 is arranged on a building structure 21 adjacent to the swimming pool entrance, the bypass switch 12 includes a switch shell 121, a first release button 122 and a second electric wire 123, the first release button 122 is exposed on the switch shell 121 and is operable, the first release button 122 is operated to generate a release signal 124 (see FIG. 9 and FIG. 10), the second electric wire 123 is connected with the switch shell 121, and the second electric wire 123 is electrically connected with the first release button 122. Furthermore, the host 13 is in informational connection with the bypass switch 12 and the door magnetic switch 11, the host 13 is arranged on the building structure 21 adjacent to the swimming pool entrance or the door 20, and the building structure 21 is not limited to a cement building and can refer to any structure on which the host 13 can be arranged, such as a fence or the like. After the host 13 is assembled to the building structure 21 or the door 20, the host 13 and the bypass switch 12 is located at different positions, wherein being located at different positions referred to herein can be expressed as the host 13 and the bypass switch 12 being located on different walls of the building structure 21, respectively, or the host 13 being located outdoors/indoors from the building structure 21 while the bypass switch 12 being located indoors/outdoors from the building structure 21. Further, the host 13 comprises a host shell 131, a speaker module 132, a second release button 133, a door magnetic switch expansion interface 134, a battery 135, and a control circuit board 136, wherein the host shell 131 includes a bottom shell 137, an upper cover 138, and a waterproof gasket 139 arranged between the bottom shell 137 and the upper cover 138. The waterproof gasket 139 serves to prevent moisture in the air from entering the host shell 131 when the host 13 is disposed adjacent to the swimming pool entrance. In addition, the speaker module 132 is arranged on the upper cover 138 of the host shell 131 and used for sounding a warning. In one embodiment, a warning decibel of the speaker module 132 can be 110 decibels, 110 decibels or more or an approximate value of 110 decibels. In addition, the second release button 133 is electrically connected with the speaker module 132, the second release button 133 is exposed on the upper cover 138 so as to be convenient for a user to operate, and the second release button 133 is likely operated to generate the release signal 124. In addition, the door magnetic switch expansion interface 134 is located at a bottom of the host shell 131, and the door magnetic switch expansion interface 134 is selectively assembled with another expanded door magnetic switch 11. The door magnetic switch expansion interface 134 is used for connection with the first electric wire 111 of the expanded door magnetic switch 11 so that the expanded door magnetic switch 11 can be connected to the host 13. Further, the battery 135 is arranged within the host shell 131 as the dashed block 164 shown in FIG. 7, and is used to provide operating power for the host 13. In addition, the control circuit board 136 is arranged in the host shell 131 and electrically driven by the battery 135, and the control circuit board 136 is electrically connected with the speaker module 132, the second release button 133, the first electric wire 111, the second electric wire 123, the door magnetic switch expansion interface 134 and the battery 135. Referring to FIG. 8 through FIG. 10, the control circuit board 136 includes a first mode in which the door opening signal 112 is received and the release signal 124 has not been received after passing a buffering time (not shown in the figures), and a second mode in which the door opening signal 112 is received and the release signal 124 is received during the buffering time. The buffering time can be set as soon as the swimming pool entrance opening warning device 10 comes out of the factory, and the buffering time can be set to 5 seconds to 20 seconds Next, referring again to FIGS. 2, 7, 8, 9 and 10, an embodiment of the swimming pool entrance opening warning device 10 will now be described. Here, it is first assumed that the door 20 is not opened, that is, the door magnetic switch 11 does not output the door opening signal 112. When a person allowed to enter the swimming pool opens the door 20, the door magnetic switch 11 outputs the door opening signal 112 to the control circuit board 136, and the control circuit board 136 receives the door opening signal 112 and waits for the buffering time to pass. When the control circuit board 136 receives the release signal 124 transmitted by the first release button 122 or the second release button 133 since the person operates the first release button 122 or the second release button 133 in the buffering time, the control circuit board 136 enters the second mode without actuating the speaker module 132 to sound a warning. On the other hand, after the door magnetic switch 11 outputs the door opening signal 112 to the control circuit board 136, when the control circuit board 136 does not receive the release signal 124 transmitted from the first release button 122 or the second release button 133 which is operated by the person during the buffering time, the control circuit board 136 enters the first mode and transmits an activation signal 140 to the speaker module 132 to actuate the speaker module 132, so that the speaker module 132 receives the activation signal 140 and then sounds a warning, and the swimming pool entrance opening warning device 10 can prompt unauthorized personnel entering the swimming pool area through the warning sound.

Compared with the prior art, in the present invention, by arranging the first release button 122, a person who intends to enter the swimming pool can, in addition to operating the second release button 133 on the host 13 so as to prevent the speaker module 132 from being activated, operate the first release button 122 which is located differently, thereby preventing the person from being limited when operating the swimming pool entrance opening warning device 10. In addition, the host 13 and the bypass switch 12 can be arranged at a certain height from the ground when the present invention is actually implemented, so that a child cannot operate the swimming pool entrance opening warning device 10 due to insufficient height, and the swimming pool entrance opening warning device 10 gives a warning when a child intends to enter the swimming pool to prevent the child from entering the swimming pool without being accompanied by an adult. Further, the host 13 of the present invention may further have a communication capability, and the host 13 may communicate to an external device (not shown in the figures) when the speaker module 132 sounds a warning, thereby causing the swimming pool entrance opening warning device 10 to inform a user of the external device that the door 20 is opened without permission.

Referring again to FIGS. 2, 3, 4 and 5, in one embodiment, the host 13 includes a bypass switch interface 141, the bypass switch interface 141 is arranged on the host shell 131 and electrically connected with the control circuit board 136, and the bypass switch interface 141 is assembled with the second electric wire 123 of the bypass switch 12, thereby enabling the bypass switch 12 to be assembled with the host 13 and actuate the speaker module 132. In addition, the bypass switch 12 is provided with a plug 125 arranged at an end of the second electric wire 123, and the plug 125 is arranged corresponding to the bypass switch interface 141, so that the bypass switch 12 can be plugged and unplugged relative to the host 13. In addition to the foregoing, in one embodiment, the host 13 further includes a host status indicator light 142 arranged on the control circuit board 136 and exposed on the host shell 131, and the host status indicator light 142 blinked when the battery 135 is not sufficiently charged which causes the host 13 to be in a low power mode, so as to prompt a user to replace the battery 135.

Accordingly, referring back to FIGS. 4, 5, 6 and 7, in one embodiment, the control circuit board 136 is composed of a motherboard 143 and a daughterboard 144, wherein the motherboard 143 is arranged on a side of an interior of the host 13 facing the bottom shell 137 and is connected with the bypass switch interface 141 and the door magnetic switch expansion interface 134, and the daughterboard 144 is electrically connected with the motherboard 143. The daughterboard 144 is arranged on a side of the interior of the host 13 facing the upper cover 138, and the host status indicator light 142 and the second release button 133 are provided on the daughterboard 144, so that the host status indicator light 142 and the second release button 133 are exposed on the upper cover 138, with the host status indicator light 142 conveniently observed and the second release button 133 operated.

On the other hand, referring back to FIGS. 4, 5, 6, 7 and 8, in one embodiment, the upper cover 138 is formed with a battery replacement opening 145 for replacement of the battery 135, the battery replacement opening 145 being able to be assembled with an enclosure 146 to prevent the battery 135 from disengaging from the battery replacement opening 145. In addition, the speaker module 132 includes a speaker 147 arranged inside the host 13 and a cap 148 provided corresponding to the speaker 147 and exposed on the upper cover 138. In more detail, the speaker 147 is electrically connected with the control circuit board 136 and receives the activation signal 140 transmitted from the control circuit board 136 to sound a warning, and the upper cover 138 is formed with a through hole 149 facing the speaker 147, the through hole 149 allowing the warning sound emitted from the speaker 147 to propagate outside the host 13. Further, the cap 148 faces and shields the through hole 149, and the cap 148 has at least one assembly post 150 extending in a direction facing the upper cover 138. The upper cover 138 has at least one assembly hole 151 provided corresponding to the assembly post 150, and the assembly hole 151 allows the assembly post 150 to be assembled so that the cap 148 can be stably assembled on the upper cover 138.

Accordingly, referring to FIGS. 2, 3, 4, 5, 6 and 7, in one embodiment, the upper cover 138 is formed with a retaining wall 152 on a side where the bottom shell 137 is assembled, and a stepped structure 153 is formed on the retaining wall 152 to which the waterproof gasket 139 is assembled, so that the present invention can prevent moisture from entering the inside of the host 13 when disposed adjacent to the swimming pool. Also, in order to enhance the waterproof function of the present invention and simultaneously increase the anti-exposure function, the upper cover 138 and the bottom shell 137 may be made of materials resistant to ultraviolet radiation and water, respectively, whereby the upper cover 138 and the bottom shell 137 have a waterproof function and are not decomposed when exposed to the sun.

Further, in one embodiment, to facilitate placement of the present invention on either the building structure 21 or the door 20, the bottom shell 137 is formed with at least one groove 154 on a side which does not face the upper cover 138 and at least two mounting posts 155 arranged within the groove 154. Specifically, the groove 154 is used for providing a shroud 156 thereon. Between an area of the groove 154 shielded by the shroud 156 and the shroud 156 there is a rope penetrating space 157 for a rope (not shown in the figures) to be received therein, and an area of the groove 154 which is not shielded by the shroud 156 defines two rope penetrating openings 158 through which the rope passes in and out, respectively. In one embodiment, the two rope penetrating openings 158 are located on a same extension line 159. In addition, the at least two mounting posts 155 extend in a direction facing the shroud 156, the at least two mounting posts 155 are used for assembling the shroud 156 and fixing the assembling position of the shroud 156. The at least two mounting posts 155 are respectively formed with an assembly opening 160 on a side facing the shroud 156. The shroud 156 includes a positioning post 161 arranged in one of the assembly openings 160 and a through hole 162 corresponding to the other assembly opening 160, the through hole 162 being provided at a side of the shroud 156 which does not have the positioning post 161, the through hole 162 allowing a screw (not shown in the figures) to penetrate through and allowing the screw to pass through the other assembly opening 160, so that the shroud 156 can be stably assembled on the groove 154. Also, in one embodiment, the shroud 156 may be formed with a fastening hole 163 communicating with the groove 154 for a mounting member provided on the building structure 21 or the door 20 (not shown in the figures) to insert therein, so that the host 13 is hung on the building structure 21 or the door 20.

What is claimed is:

1. A swimming pool entrance opening warning device, comprising:

at least one door magnetic switch, arranged on a door leading to a swimming pool entrance, wherein the at least one door magnetic switch comprises a first electric wire, and a door opening signal is output when the door is opened by the at least one door magnetic switch;

at least one bypass switch, arranged on a building structure adjacent to the swimming pool entrance, the at least one bypass switch being provided with a switch shell, a first release button exposed on the switch shell and operated to generate a release signal, and a second electric wire connected with the first release button; and a host, arranged on the building structure adjacent to the swimming pool entrance or the door, the host and the at least one bypass switch be located at different positions, the host comprising a host shell, a speaker module arranged on the host shell, a second release button exposed on the host shell and operated to generate the release signal, a door magnetic switch expansion interface exposed to the host shell, a battery arranged in the host shell, and a control circuit board connected with the speaker module, the second release button, the first electric wire, the second electric wire, the door magnetic switch expansion interface and the battery, wherein the host shell comprises a bottom shell, an upper cover and a waterproof gasket arranged between the bottom shell and the upper cover, and the control circuit board comprises a first mode of actuating the speaker module when the door opening signal is received and the release signal has not been received after passing a buffering time, and a second mode in which the door opening signal is received and the release signal is received during the buffering time.

2. The swimming pool entrance opening warning device according to claim 1, wherein the host comprises a bypass switch interface arranged on the host shell and connected with the control circuit board, and the at least one bypass switch comprises a plug arranged at an end of the second electric wire and connectable to the bypass switch interface.

3. The swimming pool entrance opening warning device according to claim 1, wherein the control circuit board is composed of a motherboard and a daughterboard electrically connected with the motherboard, and the second release button is arranged on the daughterboard.

4. The swimming pool entrance opening warning device according to claim 3, wherein the host comprises a host status indicator light exposed on the host shell, and the host status indicator light is arranged on the daughterboard.

5. The swimming pool entrance opening warning device according to claim 4, wherein the upper cover is formed with a retaining wall on a side where the bottom shell is assembled, and the retaining wall is formed with a stepped structure.

6. The swimming pool entrance opening warning device according to claim 5, wherein the bottom shell is formed with at least one groove for providing a shroud thereon on a side which does not face the upper cover and at least two mounting posts which are formed in the at least one groove and are used for assembly of the shroud, an area of the groove which is not shielded by the shroud defines two rope penetrating openings, and the two rope penetrating openings being located on a same extension line, and a fastening hole being formed on the shroud.

7. The swimming pool entrance opening warning device according to claim 6, wherein the at least two mounting posts are respectively formed with an assembly opening at a side facing the shroud, and the shroud comprises a positioning post provided at one of the assembly openings and a through hole corresponding to the other assembly opening for a screw to penetrate through.

8. The swimming pool entrance opening warning device according to claim 1, wherein the bottom shell is formed with at least one groove for providing a shroud thereon on a side which does not face the upper cover and at least two mounting posts which are formed in the at least one groove and are used for assembly of the shroud, an area of the groove which is not shielded by the shroud defines two rope penetrating openings, and the two rope penetrating openings being located on a same extension line, and a fastening hole being formed on the shroud.

9. The swimming pool entrance opening warning device according to claim 8, wherein the at least two mounting posts are respectively formed with an assembly opening at a side facing the shroud, and the shroud comprises a positioning post provided at one of the assembly openings and a through hole corresponding to the other assembly opening for a screw to penetrate through.

10. The swimming pool entrance opening warning device according to claim 1, wherein the upper cover is formed with a battery replacement opening for replacing the battery and able to be assembled with an enclosure.

* * * * *